US012104488B2

(12) United States Patent
Osterland et al.

(10) Patent No.: US 12,104,488 B2
(45) Date of Patent: Oct. 1, 2024

(54) CONSTRUCTION MACHINE AND METHOD FOR OPERATING A CONSTRUCTION MACHINE

(71) Applicant: BAUER Maschinen GmbH, Schrobenhausen (DE)

(72) Inventors: Matthias Osterland, Schrobenhausen (DE); Marco Voigt, Schrobenhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 0 days.

(21) Appl. No.: 18/154,610

(22) Filed: Jan. 13, 2023

(65) Prior Publication Data

US 2023/0228153 A1 Jul. 20, 2023

(30) Foreign Application Priority Data

Jan. 19, 2022 (EP) ..... 22152299

(51) Int. Cl.
*E21B 7/02* (2006.01)

(52) U.S. Cl.
CPC ..... *E21B 7/023* (2013.01); *E21B 7/022* (2013.01)

(58) Field of Classification Search
CPC ..... E21B 7/022; E21B 19/008; E21B 19/084; E21B 19/08
See application file for complete search history.

(56) References Cited

U.S. PATENT DOCUMENTS

2012/0305513 A1* 12/2012 Muller ..... B66C 13/28 212/284
2019/0077641 A1* 3/2019 Stensland ..... B66D 1/12
2019/0256328 A1 8/2019 Ogawa et al.

FOREIGN PATENT DOCUMENTS

DE 86 30 852 U1 1/1988
DE 90 05 485 U1 7/1990
DE 10 2014 109 918 A1 1/2016
WO 2010/089096 A1 8/2010

* cited by examiner

*Primary Examiner* — Catherine Loikith
(74) *Attorney, Agent, or Firm* — Studebaker & Brackett PC

(57) ABSTRACT

A construction machine is provided, such as a drilling rig having a mast along which a tool is movably mounted. The tool is suspended on a cable actuated by a cable winch for raising and lowering the tool, the cable winch being driven by an electric motor as a winch drive in a drive mode. The electric motor is designed to also operate in a recuperation mode in which the electric motor generates electrical energy when the tool is lowered and outputs the electrical energy to an energy store. A controller is designed to actuate the electric motor depending on a specifiable target value such that the cable is tensioned both in the drive mode and in the recuperation mode of the electric motor.

10 Claims, 1 Drawing Sheet

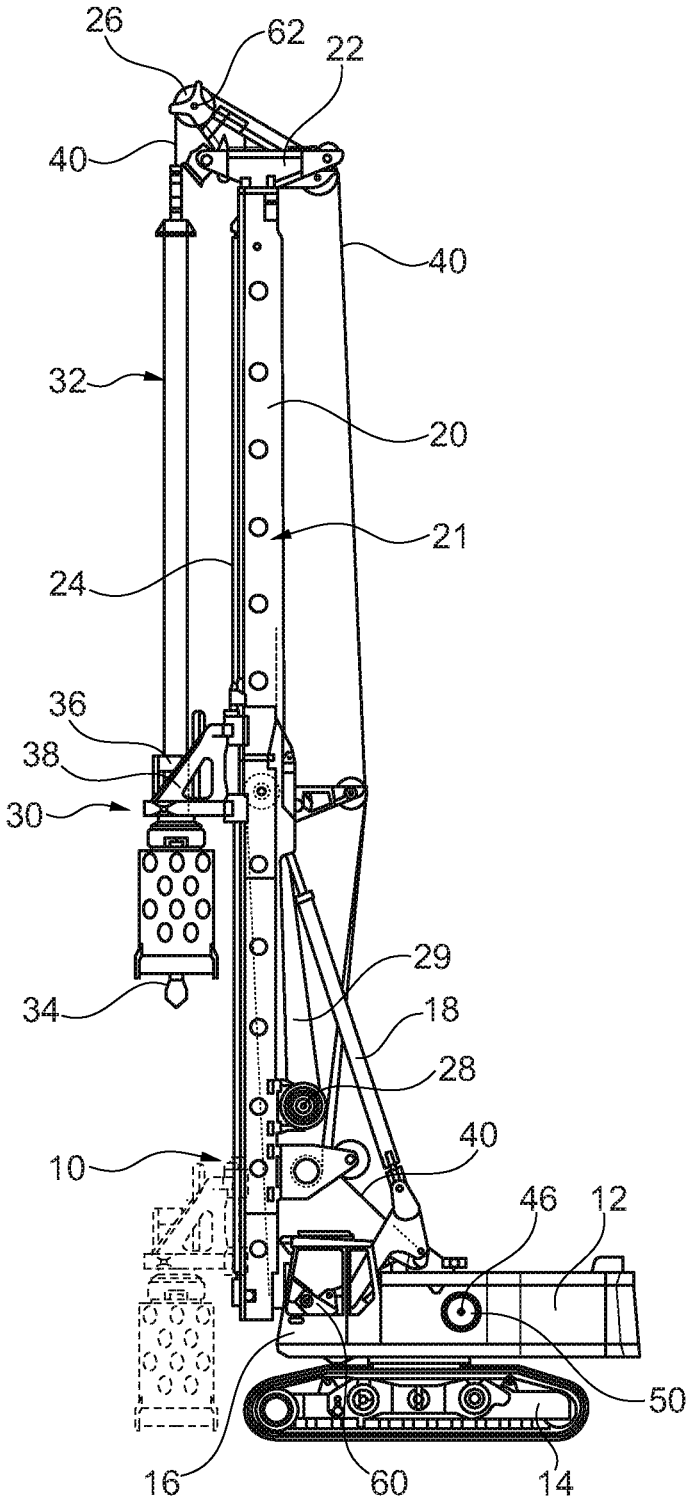
26
62
22
40
40
32
20
21
24
36
38
30
29
34
18
28
40
10
46
12
50
16
60
14

CONSTRUCTION MACHINE AND METHOD FOR OPERATING A CONSTRUCTION MACHINE

The invention relates to a construction machine according to claim 1. The invention furthermore relates to a method for operating a construction machine according to claim 8.

Construction machines comprising a mast, along which a tool is movably mounted, which tool is suspended on a cable for raising and lowering the tool, have long been known.

In the case of construction machines of this kind, a cable winch is typically driven by a hydraulic motor, which is supplied with hydraulic fluid from a hydraulic pump. The hydraulic pump is typically driven by an internal combustion engine, in particular a diesel engine.

The object of the invention is to specify a construction machine and a method for operating a construction machine, which allow for particularly economical, environmentally friendly and reliable operation.

The object is achieved on the one hand by a construction machine having the features of claim 1, and on the other hand by a method having the features of claim 7. Preferred embodiments of the invention are specified in the dependent claims.

The construction machine according to the invention, which is in particular designed as a drilling rig, comprises a mast along which a tool means is movably mounted, wherein the tool means is suspended on a cable which can be actuated by means of cable winch for raising and lowering the tool means, which cable winch is driven by an electric motor, as a winch drive, in a drive mode, wherein the electric motor is designed for operating in a recuperation mode in which the electric motor preferably generates and outputs electrical energy when the tool means is lowered, and a controller, which is designed to actuate the electric motor, depending on a specifiable target value, in such a way that the cable is tensioned both in the drive mode and in the recuperation mode of the electric motor.

A first aspect of the invention consists in using an electric motor for driving the cable winch, which motor can be operated both in a drive mode and in a recuperation mode. Thus, in particular in the case of lowering of the tool means, which can for example be a civil engineering tool, a drill drive, a ram or a vibrator, potential energy can be converted into electrical energy. Said electrical energy can be output to an energy store or an electrical energy consumer of the construction machine. In this way, the energy consumption of the machine can be reduced, which is economical and environmentally friendly.

However, the invention does not relate only to the use of an electric motor, operable in recuperative mode, for the cable winch. Rather, according to a further aspect of the invention, a controller is provided, by means of which the electric motor is operated both in the drive mode and in particular in the recuperation mode, such that a specified cable tension is ensured. For example, at particular operating timepoints, for example when a tool suspended on the cable, for example a drilling tool, is lowered into a borehole filled with a liquid, it may be the case that, upon encountering the liquid surface, the tool is braked and subsequently descents at a lower descent speed. For example, in such an operating state, the controller ensures that the electric motor, operated as a generator in recuperation mode, is operated at a reduced electromotive resistance in the case of further descent of the tool means, i.e. at a reduced braking resistance having a reduced recuperation capacity, or if necessary, at a certain pullback torque, such that the desired cable tension is ensured.

A specified cable tension in each operating state ensures that no slack line forms on the cable winch or the deflection rollers. This could otherwise cause the cable to spring out of windings or the deflection rollers, which could lead to increased cable wear, damage to the cable, or interruption of operation with repair of the construction machine.

According to a development of the invention, it is particularly expedient for the target value for the electric motor to be a specified cable traction. As a result, a minimum cable traction can be set and specified directly by a controller. The controller can accordingly control the power or the electromotive resistance of the electric motor, in particular in recuperation operation.

In this case, it is particularly advantageous for a force measuring device to be provided for measuring the cable traction, and for the force measuring device to be connected to the controller for the purpose of controlling/adjusting the electric motor depending on the measured cable traction. The traction force on the cable can be determined directly, using the force measuring device, and used for controlling the electric motor by means of the controller. This feedback of the measured value makes it possible for adjusting the electric motor dependent on the cable traction, to be achieved by means of the controller.

In principle, the force measuring device can be designed in any suitable manner. According to one embodiment of the invention, it is particularly expedient for the force measuring device to comprise a force measuring pin on a deflection roller of the cable, or a force measuring lug on a winch block of the cable winch. In this case, a direct determination of a force, for example by a load cell or force measuring strips, can be achieved.

In principle, a uniform cable traction can be set for different operating situations, in particular for the raising and lowering of the tool means. It is particularly advantageous, according to a development of the invention, for the specifiable cable traction to be variable by means of the controller. For this purpose, a corresponding input means for an operator, or an automatic change according to a specified control program, can be provided. In particular, the cable traction can change depending on the operating mode. For example, when the tool means is lowered a different minimum cable traction can be provided than when said tool means is raised. In this case, the respective specified value can be called up from a memory or input by an operator. The specified value for the cable traction can also depend on the tool means selected and attached in each case.

In principle, the construction machine can be designed in any suitable manner, in which a tool means is raised and lowered on a mast, by means of a cable. In particular in the case of repeated raising and lowering of the tool means along the mast, the arrangement according to the invention is particularly economical for energy recuperation. This may be expedient for example in the case of a ram, a vibrator or a slotted wall milling machine, or a slotted wall gripper, as are used in particular for civil engineering.

According to one embodiment of the invention, it is particularly advantageous for the construction machine to be designed as a drilling rig, on the mast of which a rotary drilling drive is adjustably mounted, which drive can be moved along the mast by means of at least one actuating drive. In this case, the tool means can in particular be a telescopic Kelly bar comprising a drilling tool. The cable can raise and lower the inner rod of the Kelly linkage, together with the drilling tool. In this case, the drilling tool can be designed as desired, in particular as an auger or particularly preferably as a drilling bucket.

The invention is particularly economical in particular in the case of discontinuous drilling, involving frequent withdrawal of the drilling tool in order to empty it.

The mast can preferably be designed as a leader, in particular a telescopic leader. The leader comprises a linear guide along the front side thereof, on which guide for example a work carriage, as or for the tool means, is guided so as to be vertically movable. In principle, within the meaning of the invention, the term "mast" is to be understood in a general manner, wherein it is also intended to cover a jib arm.

The invention furthermore relates to a method for operating a construction machine comprising a mast, along which a tool means is movably mounted, wherein the tool means is suspended on a cable which is actuated by means of a cable winch in order to raise and lower the tool means, which cable winch is driven by an electric motor, as a winch drive, in a drive mode, wherein the electric motor is designed for operation in a recuperation mode in which the electric motor preferably generates and outputs electrical energy during lowering of the tool means, wherein the electric motor is actuated by a controller dependent on a specifiable target value, such that the cable is tensioned both in the drive mode and in the recuperation mode of the electric motor.

The method according to the invention can in particular be carried out by means of the construction machine described above. The advantages described above can be achieved by means of the method. The electromotive resistance of the electric motor in the recuperation mode can be set and changed by the controller, such that a specifiable minimum value for the cable strain is ensured.

According to the invention, a preferred variant of the method consists in the electric motor being actuated dependent on a specifiable cable traction as the target value. A minimum cable traction can thus be directly specified.

According to the invention, an advantageous development consists in the specifiable traction being changed by the controller. This can take place via an input means, directly by an operator or automatically, according to a specified control program depending on particular operating parameters. Thus, for example during raising a different cable traction can be specified compared with during lowering. The specifiable cable traction can also change depending on the tool means used.

According to a variant of the invention, particularly good process control is achieved in that a cable traction is measured by means of a force measuring device, wherein the force measuring device is connected to the controller, wherein the electric motor is controlled or adjusted dependent on the measured cable traction. Thus, an actual cable traction at the cable can be determined by means of the force measuring device. Said actual cable traction is compared with the specified target cable traction. Depending on the resulting difference, the drive of the cable winch can be actuated by the controller in such a way that at least the actual cable traction is no lower than the specified target cable traction, which is specified as the minimum force for a desired cable tension.

In principle, the controller can also be designed such that the actual cable traction is adjusted thereby to the given target cable traction, or at least to a target range for the target cable traction. In this case, a maximum cable traction can also be set in the controller, as an upper limit. If the actual cable traction reaches the maximum cable traction, the electric motor of the cable winch is actuated such until the actual cable traction again falls below the maximum cable traction value.

The invention will be described in more detail in the following, with reference to a preferred, exemplary embodiment which is shown schematically in the FIGURE.

The single FIGURE is a side view of a construction machine 10 according to the invention, comprising a carrier device 12. The carrier device 12 comprises a tracked chassis as an undercarriage 14, on which an upper structure 16 is rotatably mounted. A controller 60 for the construction machine 10 is located in a control cab of the upper structure 16. A mast 20 is adjustably mounted on the upper structure 16 by means of a link mechanism 18, which mast is in a substantially vertical position during operation.

According to the exemplary embodiment shown, the mast 20 can be designed as a leader 21 having a linear guide 24 on the front side thereof. A work carriage 38 comprising a rotary drilling drive 36 can be mounted so as to be vertically movable along the linear guide 24. As a result, the construction machine 10 can be designed as a drilling rig. In the FIGURE, an upper position of the rotary drilling drive 36, and a lower position with an interrupted linear guide, are shown.

A cable 40 can be guided over a mast head 22 at the upper end of the mast 20, at one end of which cable a preferably telescopic Kelly bar 32, comprising a drilling tool 34 as the tool mean 30 is provided. The Kelly rod 32 can be guided on the work carriage 38 by means of a sleeve-like drive wheel of the rotary drilling drive 36, such that a torque can be transmitted from the rotary drilling drive 36 via carrier bars (not shown) to the Kelly bar 32. A drilling tool 34 for making a drilled hole in the ground is arranged at the lower end of the Kelly bar 32. The drilling tool 34 can in principle be designed as desired, and can in particular comprise an auger or a drilling bucket.

Proceeding from the Kelly bar 32, the cable 40 is guided along the mast 20, via deflection rollers 26 on the mast head 22, as far as a cable winch 46 in the upper structure 16. According to the invention, the cable winch 46 is driven by an electric motor 50, which can also be operated in a recuperation mode. The Kelly bar 32, together with the drilling tool 34, can be raised and lowered via the cable winch 46, by means of the cable 40. During lowering, potential energy can be converted, by the electric motor 50, into electrical energy and output to a storage device or an electrical consumer.

The work carriage 38, together with the rotary drilling drive 36, can be drawn upwards via a further adjusting cable 29, by means of an adjusting drive 28 comprising a winch, on the mast 20. Corresponding driving of the adjusting drive 28 in the opposite direction makes it possible for the work carriage 38, together with the rotary drilling drive 36 to also be lowered downwards. The adjusting drive 28 can also be equipped with an electric motor (not shown) which can likewise be operated in recuperation mode The work carriage 38 comprising the rotary drilling drive 36 can also be considered as part of the tool means 30.

In the embodiment shown, a force measuring device 62 is preferably arranged on a deflection roller 26, on the mast head 22. The force measuring device 62 can for example be designed as a force measuring pin, by means of which a cable traction at the cable 40 can be detected. The force measuring device 62 is connected to the controller 60 on the upper structure 16.

The controller 60 actuates the at least one electric motor 50 for operating the cable winch 46, and preferably also the further electric motor for operating the adjusting drive 28 designed as a winch. In this case, the actuation of the electric motor 50 by the controller 60 is carried out in such a way that the at least one electric motor 50 is actuated, depending on a specified target value for the cable traction, in such a way that the cable 40 has a provided minimum tension not only in the drive mode but also in the recuperation mode of the electric motor 50. In particular, the controller 60 can control and change an electromotive resistance of the at least one electric motor 50, wherein the recuperation capacity of the electric motor 50 also changes accordingly. The controller 60 is designed, overall, such that a minimum tension of the cable 40 is ensured, even if the recuperation capacity of the electric motor 50 is reduced as a result, compared with a maximum possible value, at least for a certain period of time. A sufficient cable tension ensures that no slack line forms, for example in the case if braking of the drilling tool 34 is taken place during lowering into a borehole filled with liquid. As a result, the formation of slack line, with the risk of the cable 40 springing out of the deflection roller 26 or a disordered winding on the cable winch 46 is prevented.

The construction machine 10 according to the invention, and the associated method according to the invention, make it possible for a more energy-saving, and thus more environmentally friendly and more economical, operation to be achieved, with still reliable operating procedure.

The invention claimed is:

1. A construction machine comprising:

a mast along which a tool means is movably mounted, wherein the tool means is suspended on a cable which can be actuated by means of a cable winch for raising and lowering the tool means, which cable winch is driven by an electric motor as a winch drive in a drive mode, wherein the electric motor is designed for operating in a recuperation mode in which the electric motor generates and outputs electrical energy when the tool means is lowered, and a controller which is designed to actuate the electric motor depending on a specifiable target value, in such a way that the cable is tensioned both in the drive mode and in the recuperation mode of the electric motor.

2. The construction machine according to claim 1, wherein the target value for the electric motor is a specified cable traction.

3. The construction machine according to claim 2, wherein a force measuring device is provided for measuring the cable traction, and in that the force measuring device is connected to the controller for the purpose of controlling the electric motor depending on the measured cable traction.

4. The construction machine according to claim 3, wherein the force measuring device comprises a force measuring pin on a deflection roller of the cable, or a force measuring lug on a winch block of the cable winch.

5. The construction machine according to claim 2, wherein the specifiable cable traction can be changed by means of the controller.

6. The construction machine according to claim 1, wherein the construction machine is designed as a drilling rig, on the mast of which a rotary drilling drive is adjustably mounted, which drive can be moved along the mast by means of at least one actuating drive.

7. A method for operating a construction machine, the method comprising:

providing the construction machine comprising a mast along which a tool means is movably mounted, wherein the tool means is suspended on a cable which is actuated by means of a cable winch in order to raise and lower the tool means, which cable winch is driven by an electric motor as a winch drive in a drive mode, wherein the electric motor is designed for operation in a recuperation mode in which the electric motor generates and outputs electrical energy during lowering of the tool means, and actuating the electric motor dependent on a specifiable target value, such that the cable is tensioned both in the drive mode and in the recuperation mode of the electric motor.

8. The method according to claim 7, comprising actuating the electric motor dependent on a specifiable cable traction as the target value.

9. The method according to claim 8, wherein the specifiable cable traction is changed by a controller or an operator.

10. The method according to claim 7, wherein a cable traction is measured by means of a force measuring device, and wherein the electric motor is controlled or adjusted dependent on the measured cable traction.

* * * * *